US008923726B2

(12) United States Patent
Tsuda et al.

(10) Patent No.: US 8,923,726 B2
(45) Date of Patent: Dec. 30, 2014

(54) IMAGE FORMING APPARATUS INCORPORATING DEVELOPING DEVICE WITH FIRST AND SECOND SEALS

(75) Inventors: Kiyonori Tsuda, Kanagawa (JP); Hideo Yoshizawa, Kanagawa (JP); Kohichi Utsunomiya, Kanagawa (JP); Takuzi Yoneda, Tokyo (JP); Yutaka Takahashi, Kanagawa (JP); Emi Kita, Kanagawa (JP); Yuki Oshikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 138 days.

(21) Appl. No.: 13/430,004

(22) Filed: Mar. 26, 2012

(65) Prior Publication Data

US 2012/0269544 A1 Oct. 25, 2012

(30) Foreign Application Priority Data

Apr. 21, 2011 (JP) ..... 2011-094720
Jul. 25, 2011 (JP) ..... 2011-161981

(51) Int. Cl.
*G03G 15/08* (2006.01)

(52) U.S. Cl.
USPC ..... 399/103

(58) Field of Classification Search
USPC ..... 399/103, 104, 105
IPC ... G03G 15/0817,15/0898, 15/0942, 2215/0877
See application file for complete search history.

(56) References Cited

U.S. PATENT DOCUMENTS 4,792,831 A * 12/1988 Takeda et al. ..... 399/105
4,897,693 A * 1/1990 Sawayama ..... 399/104
6,771,918 B2 * 8/2004 Tatsumi ..... 399/103
6,826,378 B2 * 11/2004 Ochiai ..... 399/103
7,769,316 B2 * 8/2010 Kimura ..... 399/103
7,826,776 B2 11/2010 Tsuda et al.
7,890,028 B2 2/2011 Miyamoto et al.
7,899,368 B2 3/2011 Yoshida et al.

(Continued)

FOREIGN PATENT DOCUMENTS

JP 2002-278287 9/2002
JP 2002-287503 10/2002

(Continued)

OTHER PUBLICATIONS

U.S. Appl. No. 13/435,168, filed Mar. 30, 2012, Yoshizawa, et al.

*Primary Examiner* — Robert Beatty
(74) *Attorney, Agent, or Firm* — Oblon, Spivak, McClelland, Maier & Neustadt, L.L.P.

(57) ABSTRACT

A development device includes a development casing, a developer bearer disposed facing a latent image bearer through an opening formed in the development casing, a magnetic field generator, a developer regulator disposed facing the developer bearer, a first seal member to cover a clearance between the latent image bearer and a rim of the development casing upstream from the opening, and a second seal member. The first seal member includes a first end portion fixed to the rim of the development casing and a second end portion in contact with the latent image bearer, and the second seal member includes a first end portion fixed to an inner face of the development casing farther from the latent image bearer than the first seal member, and a second end portion hanging to contact the developer carried on the developer bearer downstream from the developer regulator.

14 Claims, 5 Drawing Sheets

(56) References Cited

U.S. PATENT DOCUMENTS

| | | | |
|---|---|---|---|
| 7,937,027 | B2 | 5/2011 | Kato et al. |
| 7,962,071 | B2 | 6/2011 | Tsuda et al. |
| 8,010,020 | B2 | 8/2011 | Kita et al. |
| 8,135,311 | B2 | 3/2012 | Tsuda et al. |
| 2008/0187332 | A1 | 8/2008 | Tsuda et al. |
| 2008/0253810 | A1 | 10/2008 | Tateyama et al. |
| 2008/0317508 | A1 | 12/2008 | Terai et al. |

FOREIGN PATENT DOCUMENTS

| | | |
|---|---|---|
| JP | 2004-317567 | 11/2004 |
| JP | 2005-201943 | 7/2005 |
| JP | 2008-181047 | 8/2008 |

* cited by examiner

IMAGE FORMING APPARATUS INCORPORATING DEVELOPING DEVICE WITH FIRST AND SECOND SEALS

CROSS-REFERENCE TO RELATED APPLICATIONS

This patent application is based on and claims priority pursuant to 35 U.S.C. §119 to Japanese Patent Application No. 2011-094720 filed on Apr. 21, 2011, and 2011-161981 filed on Jul. 25, 2011, in the Japan Patent Office, the entire disclosure of each of which is hereby incorporated by reference herein.

FIELD OF THE INVENTION

The present invention generally relates to a development device using two-component developer consisting essentially of toner and carrier, a process cartridge including the same, and an image forming apparatus, such as a copier, a printer, a facsimile machine, or a multifunction machine having at least two of these capabilities, that includes the same.

BACKGROUND OF THE INVENTION

Two-component developer is widely used in development devices for electrophotographic image forming apparatuses. In development devices, developer is carried on a developer bearer, and a developer regulator adjusts the amount of developer carried on the developer bearer. Then, the developer is transported to a development range facing a latent image bearer (e.g., a photoreceptor) as the developer bearer rotates. At that time, the developer is subject to centrifugal force or airflow inside the development device, and it is possible that the developer (i.e., carrier particles or toner particles) is scattered inside or outside the development device. Therefore, various approaches have been tried to prevent scattering of developer.

If developer scatters outside a development casing, it is possible that the developer adheres to the latent image bearer upstream from the development range in the direction in which the latent image bearer rotates, resulting in contamination inside the image forming apparatus. Therefore, typically a sheet to prevent scattering of developer (hereinafter "scattering prevention sheet") is provided to fill in a clearance between the rim of the development casing adjacent to the opening (i.e., an opening rim) and the surface of the latent image bearer on the upstream side in the direction of rotation of the latent image bearer, thereby preventing scattering of developer. Although such a sheet is effective initially, the developer eventually adheres to a surface of the sheet facing the developer bearer and accumulates thereon. Upon an impact, the accumulating developer can drop and degrade image quality.

In view of the foregoing, for example, JP-2004-317567-A proposes providing a sheet to cover a developer layer downstream from the developer regulator (hereinafter "accumulation prevention sheet"), thus preventing accumulation of developer, in addition to the scattering prevention sheet. An end of the accumulation prevention sheet is fixed to an inner wall of the development casing, and another end of the sheet is not fixed (i.e., a free end) but in contact with an end of the scattering prevention sheet.

This configuration can prevent the developer from adhering to the surface of the scattering prevention sheet facing the developer bearer. Even if the developer adheres to the accumulation prevention sheet, the developer carried on the developer bearer slides on the surface of the accumulation prevention sheet facing the developer bearer, thereby inhibiting accumulation of developer thereon.

To fix the developer accumulation prevention sheet, an edge face thereof is in contact with the developer scattering prevention sheet.

Additionally, various approaches have been tried to prevent scattering of toner around the developer bearer (e.g., development roller) inside the development device. For example, to prevent toner that has left the development roller from scattering outside the development device, an insulative seal member is provided around the development roller. Alternatively, airflow is generated to prevent scattering of toner.

For example, the development roller is covered with a seal member extending in the longitudinal direction of the development roller, and an edge face of the seal member is in contact with the photoreceptor disposed facing the development roller. In such configurations, the seal member that covers the portion of the development roller exposed from the development casing may be curved into an arc, and an insulative member such as a urethane sheet is provided at an end of the seal member in contact with the photoreceptor.

The arc-shaped seal member and the urethane sheet, however, tend to be electrically charged due to friction with toner, and toner can adhere to them. If the toner falls from the arc-shaped seal member or the urethane sheet under its own weight or upon an impact, it can degrade image quality or contaminate the interior of the apparatus.

To prevent accumulation of electrical charges, for example, in JP-2005-201943-A, the side of the seal member facing the development roller is constructed of an electroconductive member that is grounded.

BRIEF SUMMARY OF THE INVENTION

In view of the foregoing, one embodiment of the present invention provides a development device that includes a development casing, a developer bearer to carry by rotation two-component developer including toner and carrier, a magnetic field generator disposed inside the developer bearer, a developer regulator to adjust an amount of developer carried on the developer bearer. The developer bearer is disposed facing a latent image bearer through an opening formed in the development casing, and the developer regulator is disposed upstream from a development range in a direction of rotation of the developer bearer and facing the developer bearer across a predetermined gap. The development device further includes a first seal member to cover a clearance between the latent image bearer and a rim of the development casing adjacent to and upstream from the opening. The first seal member includes a first end portion fixed to the rim of the development casing upstream from the development range in the direction of rotation of the developer bearer, and a second end portion in contact with the latent image bearer. Additionally, a second seal member is provided to the development casing. A first end portion of the second seal member is fixed to an inner face of the development casing farther from the latent image bearer than the first end portion of the first seal member, and a second end portion of the second seal member hangs under its own weight to contact the developer carried on the developer bearer downstream from the developer regulator in the direction of rotation of the developer bearer.

In another embodiment, a development device includes the above-described development casing and the above-described developer bearer, and further includes a developer conveyance member to transport the developer inside the development casing, a seal member provided to a rim of the development casing adjacent to the opening, and a conductor to electrically connect the seal member to the developer bearer at an identical electrical potential. The seal member extends to a position adjacent to a development nip between the developer bearer and the latent image bearer. The seal member includes an insulative member and an electroconductive member disposed on a side of the development casing, and a side of the developer bearer, respectively.

In yet another embodiment, a development device includes the above-described development casing, developer conveyance member, developer bearer, and seal member. In this embodiment, an electrical potential of the developer bearer and that of the electroconductive member of the seal member are set so that the difference in electrical potential between the developer bearer and the electroconductive member causes an electrical field directing the developer toward the developer bearer.

In yet another embodiment provides an image forming apparatus including one of the above-described development devices.

In yet another embodiment provides a process cartridge including the latent image bearer and one of the above-described development devices.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
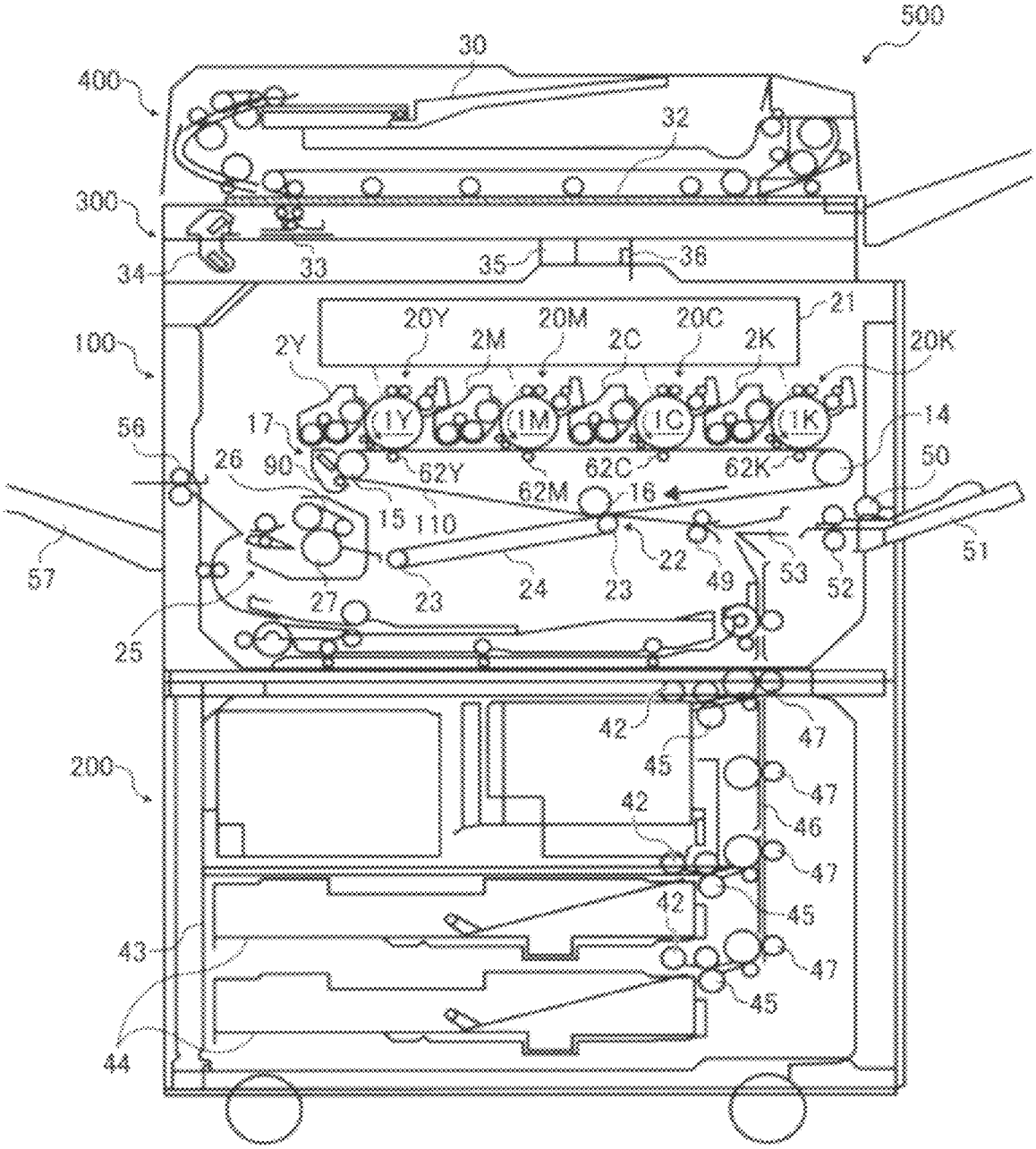
FIG. 1 is a schematic diagram illustrating an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

An image forming apparatus 500 shown in FIG. 1 can be, for example, a copier, and includes a printer unit 100, a sheet feeder 200 on which the printer unit 100 is mounted, and a scanner 300 fixed above the printer unit 100. The image forming apparatus 500 further includes an automatic document feeder (ADF) 400 fixed on the scanner 300.

The printer unit 100 includes four image forming units 20Y, 20M, 20C, and 20K for forming yellow (Y), magenta (M), cyan (C), and black (K) images. It is to be noted that suffixes Y, M, C, and K attached to each reference numeral indicate only that components indicated thereby are used for forming yellow, magenta, cyan, and black images, respectively, and hereinafter may be omitted when color discrimination is not necessary.

The image forming apparatus 500 further includes an optical writing unit 21, an intermediate transfer unit 17, a secondary transfer device 22, a pair of registration rollers 49, and a belt-type fixing device 25.

The optical writing unit 21 includes a light source, a polygon mirror, an f-θ lens, and reflection mirrors, and is configured to direct a laser beam onto the surface of a photoreceptor 1 according to image data.

Each image forming unit 20 includes a drum-shaped photoreceptor 1, and four photoreceptors 1 are arranged in parallel to each other, facing an intermediate transfer bet 110 of the intermediate transfer unit 17.

The image forming apparatus 500 may further includes a sheet reversal unit to reverse sheets for duplex printing.

The image forming units 20 are described in further detail below using the image forming unit 20 for yellow.

The surface of the photoreceptor 1Y is uniformly charged by a charging device. Then, the optical writing unit 21 directs the laser beam, which is modulated and deflected, to the charged surface of the photoreceptor 1Y. The laser beam (exposure light) attenuates the electrical potential of the portion of the photoreceptor 1Y thus exposed, forming an electrostatic latent image for yellow thereon. Then, a development device 2Y develops the electrostatic latent image formed on the photoreceptor 1Y into a yellow toner image.

The yellow toner image is primarily transferred from the photoreceptor 1Y onto the intermediate transfer belt 110. Subsequently, a drum cleaning unit removes toner remaining on the surface of the photoreceptor 1Y. Further, a discharger removes electrical potential remaining on the photoreceptor 1Y, after which the charging device uniformly charges the surface of the photoreceptor 1Y, thus initializing the photoreceptor 1Y. The above-described processes are also performed in other image forming units 20 similarly.

Next, the intermediate transfer unit 17 is described below.

The intermediate transfer unit 17 includes the intermediate transfer belt 110, a belt cleaning unit 90, a tension roller 14, a driving roller 15, a backup roller 16, and four primary-transfer bias rollers 62. The backup roller 16 presses the intermediate transfer belt 110 against a tension roller 23 of the secondary-transfer device 22, thus forming a secondary-transfer nip therebetween.

The intermediate transfer belt 110 is stretched around multiple rollers including the tension roller 16 and rotates clockwise in FIG. 1 as the driving roller 15 rotates, driven by a belt driving motor. The four primary-transfer bias rollers 62 are disposed in contact with an inner circumferential surface of the intermediate transfer belt 110 and receive a primary transfer bias from a power source.

The four primary-transfer bias rollers 62 press the intermediate transfer belt 110 against the photoreceptors 1 from the inner circumferential side, forming primary-transfer nips therebetween. The primary transfer bias causes a primary-transfer electrical field between the photoreceptor 1 and the primary-transfer bias roller 62 in each primary-transfer nip. The yellow toner image is transferred from the photoreceptor 1Y onto the intermediate transfer belt 110 with the effects of the primary-transfer electrical field and the nip pressure. Subsequently, magenta, cyan, and black toner images are transferred from the photoreceptors 1M, 1C, and 1K and superimposed one on another on the yellow toner image. Thus, a superimposed four-color toner image is formed on the intermediate transfer belt 110.

The four-color toner image formed on the intermediate transfer belt 110 is transferred onto the sheet in the secondary-transfer nip (secondary-transfer process). The belt cleaning unit 90 is provided downstream from the secondary-transfer nip in the sheet conveyance direction, pressing against the driving roller 15 via the intermediate transfer belt 110. The belt cleaning unit 90 removes any toner remaining on the intermediate transfer belt 110 after the secondary transfer process.

The secondary transfer device 22 is described in further detail below.

The secondary transfer device 22 is disposed beneath the intermediate transfer unit 17 in FIG. 1 and includes a conveyance belt 24 looped around two tension rollers 23. The conveyance belt 24 rotates counterclockwise in FIG. 1 as at least one of the two tension rollers 23 rotates. The intermediate transfer belt 110 and the conveyance belt 24 are nipped between the backup roller 16 and the tension roller 23 on the right in FIG. 1. Thus, the intermediate transfer belt 110 is in contact with the conveyance belt 24, forming the secondary-transfer nip.

A secondary-transfer bias whose polarity is opposite to the polarity of toner is applied to the tension roller 23 on the right from a power source. The secondary-transfer bias causes secondary-transfer electrical field in the secondary-transfer nip to electrically transfer the four-color toner image from the intermediate transfer belt 110 toward the tension roller 23. Timed to coincide with transferring of the four-color toner image, the registration rollers 49 forward the sheet to the secondary-transfer nip, and the four-color toner image is secondarily transferred on the sheet. It is to be noted that, instead of applying the secondary-transfer bias to one of the tension rollers 23, a contactless charger to charge the sheet may be provided.

The sheet feeder 200 disposed beneath the main body of the apparatus includes a paper bank 43 in which multiple sheet cassettes 44 are arranged vertically. Each sheet cassette 44 contains multiple sheets stacked on top of another. Each sheet cassette 44 is provided with a feed roller 42 pressed against the sheet on top in the sheet cassette 44. As the feed roller 42 rotates, the sheet is conveyed to a feeding path 46.

Multiple pairs of conveyance rollers 47 are provided along the feeding path 46, and the pair of registration rollers 49 is provided at an end portion of the feeding path 46. The sheet is conveyed toward the registration rollers 49 and then clamped in the nip between the registration rollers 49.

Meanwhile, the four-color toner image formed on the intermediate transfer belt 110 is transported to the secondary-transfer nip as the intermediate transfer belt 110 rotates. The registration rollers 49 forward the sheet clamped therebetween so that it can contact the four-color image in the secondary-transfer nip. Thus, the four-color toner image is transferred onto the sheet in the secondary-transfer nip, forming a full-color image on the while sheet. As the conveyance belt 24 rotates, the sheet carrying the full-color toner image is discharged from the secondary-transfer nip and conveyed to the fixing device 25.

The fixing device 25 includes a belt unit to rotate a fixing belt 26 looped around two rollers as well as a pressure roller 27 pressed against one of the two rollers of the belt unit. The fixing belt 26 and the pressure roller 27 press against each other, forming a fixing nip therebetween, and the sheet conveyed by the conveyance belt 24 is clamped in the fixing nip. A heat source is provided inside the roller against which the pressure roller 27 presses to heat the fixing belt 26. With the heat and pressure, the toner image is fixed on the sheet in the fixing nip (fixing process).

After the fixing process, discharge rollers 56 discharge the sheet to a stack tray 57 protruding from a side plate of the housing of the apparatus on the left in FIG. 1. Alternatively, the sheet is conveyed again to the secondary-transfer nip for duplex printing.

To make copies of originals, image data of the originals are read by the scanner 300. The scanner 300 includes a first carriage 33 including a light source, a second carriage 34 including a mirror, an imaging lens 35, and a reading sensor 36. Users can place a bundle of originals, for example, on a document table 30 of the ADF 400.

It is to be noted that, if the bundle of originals is bound like a book on one side (side-stitched documents), the bundle is placed on an exposure glass 32 of the scanner 300. Specifically, the user lifts the ADF 400 to expose the exposure glass 32 of the scanner 300, sets the bundle on the exposure glass 32, and then lowers the ADF 400 so as to hold the bundle with the ADF 400.

Then, the user presses a copy start switch, and the scanner 300 starts reading image data of the originals. When the originals are set on the ADF 400, the ADF automatically conveys the originals to the exposure glass 32 before reading of image data. In reading of image data, the first and second carriages 33 and 34 start moving, and the first carriage 33 directs an optical beam from the light source onto the original. Subsequently, the optical beam reflected from a surface of the original is reflected by the mirror of the second carriage 34, passes through the imaging lens 35, and then enters the reading sensor 36. Thus, the reading sensor 36 obtains the image data of the original document.

In parallel to reading of image data, components of the respective image forming units 20, the intermediate transfer unit 17, the secondary transfer device 22, and the fixing device 25 start operating. According to the image data obtained by the reading sensor 36, the optical writing unit 21 is driven, and yellow, magenta, cyan, and black toner images are respectively formed on the photoreceptors 1Y, 1M, 1C, and 1K, which are superimposed one on top of another on the intermediate transfer belt 110.

Additionally, almost simultaneously with the start of image data reading, the sheet feeder 200 starts feeding sheets. Specifically, one of the feed rollers 42 is selectively rotated, and the sheets are fed from the corresponding sheet cassette 44. The sheets are fed one by one to the feeding path 46, separated by a separation roller 45, after which the pairs of conveyance rollers 47 convey the sheet to the secondary-transfer nip. Instead of the sheet cassette 44, the sheets may be fed from a side tray 51 projecting from the side of the apparatus. In this case, a feed roller 50 is rotated to feed the sheets from the side tray 51, and a separation roller 52 forwards the sheets one by one to a feed path 53 inside the printer unit 100.

When multicolor toner images are formed, the intermediate transfer belt 110 is disposed with its upper portion substantially horizontal so that the photoreceptors 1Y, 1M, 1C, and 1K are in contact with the upper side of the intermediate transfer belt 110. By contrast, when monochrome images (black toner images) are formed, the left side of the intermediate transfer belt 110 in FIG. 1 is lowered, thus disengaging the intermediate transfer belt 110 from the photoreceptors 1Y, 1M, and 1C. Then, only the photoreceptor 1K among the four photoreceptors 1 is rotated counterclockwise in FIG. 1. At that time, not only the photoreceptor 1 but also the development device 2 is stopped in each of the image forming units 20Y, 20M, and 20C to prevent wear of the photoreceptors 1 or waste of developer.

Although not shown in FIG. 1, the image forming apparatus 500 further includes a controller for controlling operations of respective parts thereof and an operation panel including a display and various keys. Regarding simplex printing to form an image on only one side of the sheet, the image forming apparatus 500 can offer three different modes: a direct discharge mode, a reverse discharge mode, and a reverse decal discharge mode. The user can select one of these modes by sending a command to the controller from the operation panel.

Figure 2:
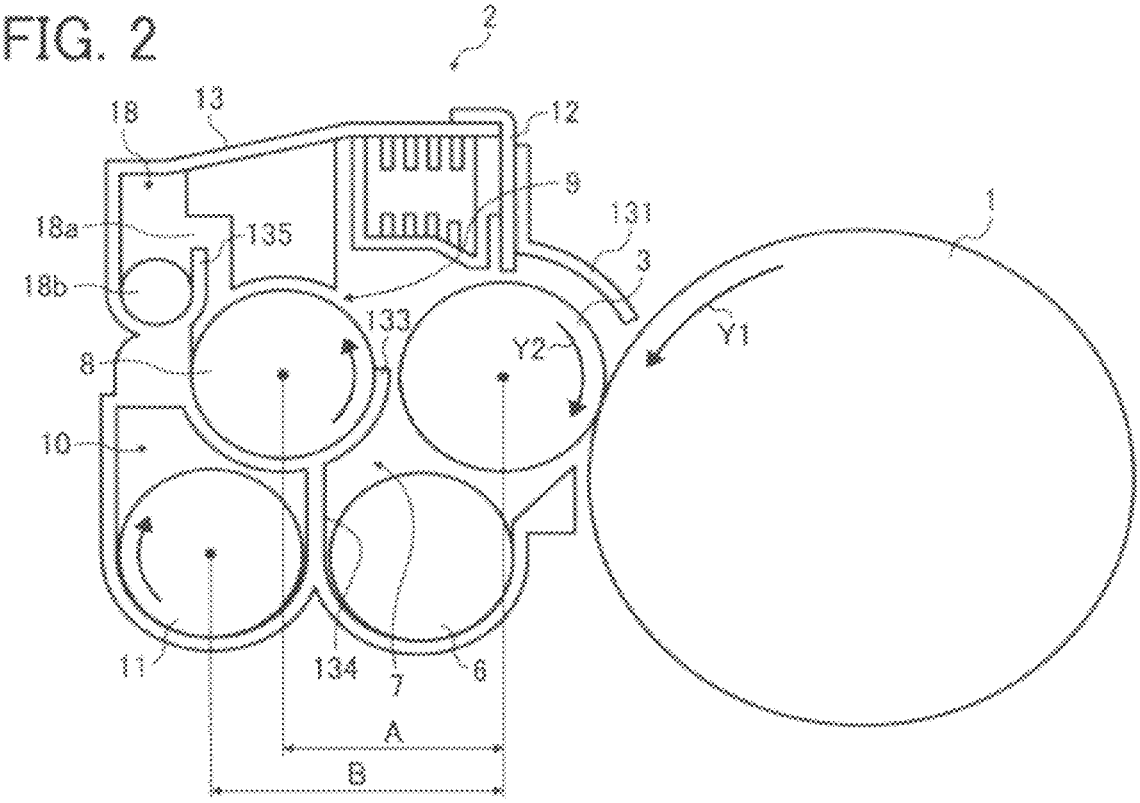
FIG. 2 is a schematic end-on axial view illustrating an image forming unit according to an embodiment.

FIG. 2 is a schematic end-on axial view illustrating the image forming unit 20. It is to be noted that the four image forming units 20Y, 20M, 20C, and 20K have a similar configuration except the color of toner used therein, and the subscripts Y, K, M, and C attached to the end of reference numerals are omitted in FIG. 2.

The development device 2 includes a development casing 13 for containing two-component developer consisting essentially of toner and magnetic carrier and a development roller 3 serving as a developer bearer to carry thereon the developer. An opening is formed in the development casing 13 at a position facing the photoreceptor 1, which rotates counterclockwise in FIG. 2 as indicated by arrow Y1, and the development roller 3 is partly exposed from the opening.

The development roller 3 rotates clockwise in FIG. 2 as indicated by arrow Y2. The development roller 3 is disposed so that a minute clearance is kept between the exposed surface thereof and the surface of the photoreceptor 1. The development roller 3 includes a cylindrical development sleeve 301 constructed of an electroconductive, nonmagnetic material and a magnet roller 302, serving as a magnetic field generator, disposed inside the development sleeve 301. It is to be noted that the term "cylindrical" used in this specification is not limited to round columns but also includes polygonal prisms.

The magnet roller 302 includes multiple stationary magnetic poles. In the configuration shown in FIG, a main development pole P1 corresponding to the development range and a conveyance pole P2 upstream from the main development pole P1 in the direction of rotation of the development roller 3, are formed around the development roller 3.

The development sleeve 301 rotates, thus moving relatively to the magnet roller 302, in a direction following the direction of rotation of the photoreceptor 1. Further, a power source is connected to the development sleeve 301 to apply a development bias thereto. When the development bias is applied to the development sleeve 301, an electrical field (i.e., development field) is formed between the surface of the development roller 3 and the surface of the photoreceptor 1 in a development range where the development roller 3 faces the photoreceptor 1. The development field causes toner contained in the developer carried on the surface of the development roller 3 to adhere to the electrostatic latent image formed on the photoreceptor 1, thus developing it into a toner image. In image development, the magnetic field formed by the magnet roller 302 causes the magnetic carrier in the developer to stand on end on the development sleeve 301 in the development range, thus forming a magnetic brush.

The development device 2 further includes a doctor blade 12 serving as a developer regulator that adjusts the amount of developer carried on the development roller 3 and conveyed to the development range. Further, first and second entrance seals 4 and 5 (shown in FIG. 3), serving as first and second seal members, are provided at an opening rim 131 of the development casing 13 adjacent to the opening through which the development roller 3 faces the photoreceptor 1. Specifically, the opening rim 131 is upstream form the opening in the direction of rotation of the development roller 3 indicated by arrow Y2.

The developing device 2 further includes a supply screw 8 and a collecting screw 6 positioned downstream from a development range where the development roller 3 faces the photoreceptor 1 in the direction of rotation of the development roller 3. The supply screw 8 transports the developer to the front side of the paper on which FIG. 2 is drawn while supplying the developer to the development roller 3. The collecting screw 6 collects the developer that has passed through the development range and transports the collected developer in the direction identical to the direction in which the supply screw 8 transports the developer (hereinafter "developer conveyance direction"). The development roller 3 and a supply compartment 9 in which the supply screw 8 is provided are arranged laterally, and a collecting compartment 7 in which the collecting screw 6 is provided is positioned beneath the development roller 3.

The development device 2 further includes an agitation compartment 10 beneath the supply compartment 9 and in parallel to the collecting compartment 7. In the agitation compartment 10, an agitation screw 11 is provided to transport the developer toward the back side of the paper on which FIG. 2 is drawn, while agitating the developer. The agitation screw 11 transports the developer in the direction opposite the developer conveyance direction of the supply screw 8.

Figure 3:
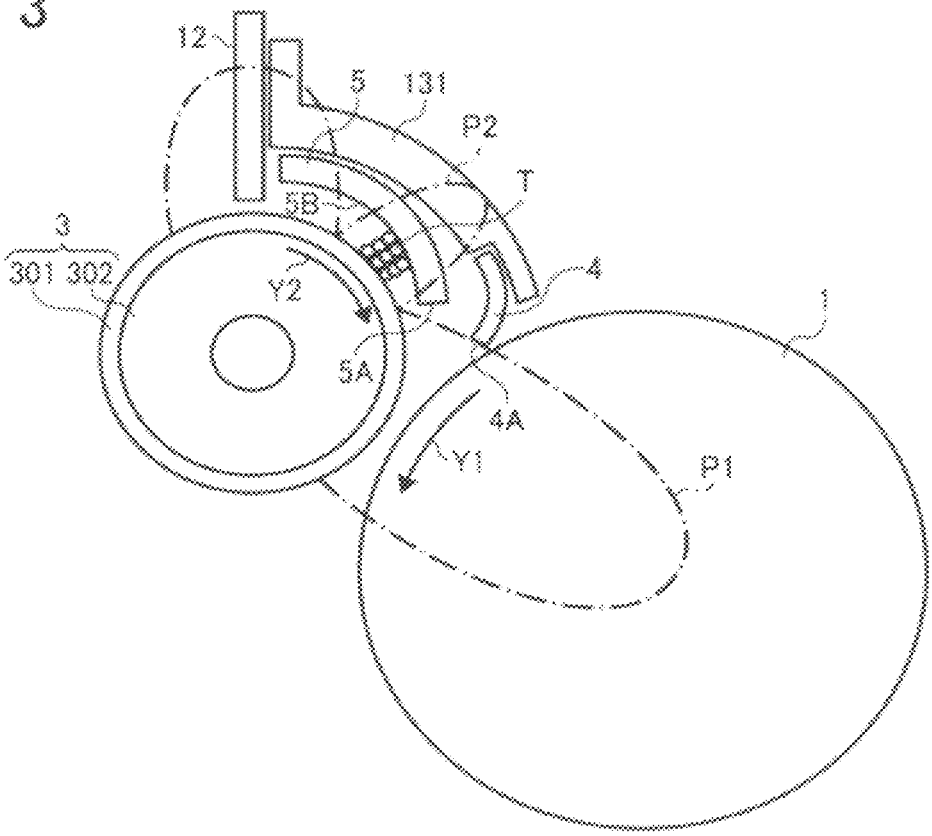
FIG. 3 is an enlarged view illustrating a development device in the image forming unit.

The development device 2 further includes a first separation wall 133 that includes a portion separating the supply compartment 9 from the agitation compartment 10. Although separated by the first separation wall 133, the supply compartment 9 and the agitation compartment 10 communicates with each other in both end portions in the direction perpendicular to the surface of paper on which FIG. 3 is drawn, through openings, namely, a first communication portion and a third communication portion respectively formed on the front side and the back side of the paper.

Additionally, a second separation wall 134 that includes a portion separating the agitation compartment 10 from the collecting compartment 7 is provided. Although separated by the second separation wall 134, an opening (second communication portion) through which the agitation compartment 10 communicates with the collecting compartment 7 is formed in the second separation wall 134, in an end portion, that is, on the front side of paper on which FIG. 2 is drawn. It is to be noted that the supply compartment 9 and the collecting compartment 7 are separated by the first partition 133 as well, and no opening is formed in that portion of the first partition 133. Thus, the supply compartment 9 does not communicate with the collecting compartment 7.

After being used in image development, the developer is collected in the collecting compartment 7 and then is conveyed to the front side of the paper on which FIG. 2 is drawn. The collected developer is further conveyed through the opening (second communication portion) formed in the second separation wall 134, in a non-image area, to the agitation compartment 10. It is to be noted that premixed toner, in which toner and carrier are mixed, is supplied to the agitation compartment 10 through a toner supply port formed on an upper side of the agitation compartment 10, positioned close to the opening formed in the first separation wall 133.

The supply compartment 9 includes a discharge path 18 to discharge the developer from the supply compartment 9 outside the development device 2 when the amount of developer inside the development device 2 becomes excessive resulting from the supply of premixed toner or the like. The developer is discharged through a discharge opening 18*a* to the discharge path 18, and a discharge screw 18*b* is provided in the discharge path 18. Specifically, the discharge path 18 is formed by a partition 135 and the development casing 13 and is positioned on the side of the supply compartment 9 via the partition 135. The discharge opening 18*a* is formed in an end portion of the partition 135 on the downstream side in the developer conveyance direction in the supply compartment 9. That is, the discharge opening 18*a* serves as a communication portion between the supply compartment 9 and the discharge path 18.

Next, circulation of developer inside the three compartments formed in the development casing 13 (i.e., a developer container) is described below.

In the supply compartment 9, the supply screw 8 transports the developer supplied from the agitation compartment 10 downstream while supplying it to the development roller 3. The developer that is not supplied to the development roller 3 but is transported to the downstream end portion of the supply compartment 9 (i.e., excessive developer) is transported through the opening (first communication portion) formed in the first separation wall 133 to the agitation compartment 10. The developer collected from the development roller 3 in the collecting compartment 7 is transported by the collection screw 6 to a downstream end portion of the collecting compartment 7, after which the collected developer is transported to the agitation compartment 10 through the opening or second communication portion formed in the second separation wall 134.

In the agitation compartment 10, the excessive developer, the collected developer, and toner supplied as required are mixed together and transported by the agitation screw 11 to a downstream end portion of the agitation compartment 10, which is on the upstream side in the conveyance direction of the supply screw 8. The developer conveyance direction in the agitation compartment 10 is opposite the direction in which the developer is transported in the collecting compartment 7 as well as the supply compartment 9.

Subsequently, the developer is transported from the downstream end portion of the agitation compartment 10 to an upstream end portion of the supply compartment 9 through the opening formed in the first separation wall 133. It is to be noted that a toner concentration detector is provided beneath the agitation compartment 10, and toner is supplied by a toner supply device from a toner container according to outputs from the toner concentration detector.

In the above-described development device 2, the used developer does not directly enter the supply compartment 9 because supply and collection of developer are performed in the supply compartment 9 and the collecting compartment 7, respectively. Therefore, decreases in toner concentration in the developer supplied to the development roller 3 on the downstream side in the supply compartment 9 can be prevented or reduced.

Additionally, collection and agitation of developer are performed in different developer conveyance compartments, namely, the collecting compartment 7 and the agitation compartment 10, which can prevent the used developer from being supplied to the development roller 3 during agitation. Therefore, only sufficiently agitated developer is allowed to enter the supply compartment 9. In other words, decreases in concentration of toner in the developer in the supply compartment 9 can be prevented or alleviated, and accordingly image density can be kept constant.

It is to be noted that, as the agitation screw 11 rotates, developer is pressed to the downstream side of the agitation compartment 10 and is piled up, and accordingly the developer is transported from the agitation compartment 10 upward to the supply compartment 9. While thus being pressed and transported upward, the developer can receive stress, which shortens the useful life of the developer. Additionally, due to the stress on the developer, film of carrier particles can be scraped off and toner particles can be degraded, resulting in decreases in image quality.

Therefore, it is preferred to alleviate stress on the developer caused by upward movement of developer to expand useful life of developer. Additionally, alleviating stress on the developer can reduce deterioration of developer. As a result, satisfactory image quality can be maintained with fluctuations in image density reduced.

In view of the foregoing, as shown in FIG. 2, the supply compartment 9 is positioned obliquely above the agitation compartment 10 in the development device 2 according to the present embodiment. With this arrangement, stress on the developer caused by the upward movement can be reduced compared with a configuration in which the supply compartment 9 is positioned vertically above the agitation compartment 10. In addition, as shown in FIG. 2, by arranging the supply compartment 9 and the agitation compartment 10 obliquely in a vertical direction, a surface of an upper wall of the agitation compartment 10 is higher than a surface of a bottom wall of the supply compartment 9.

In the arrangement in which the supply compartment 9 is disposed vertically above the agitation compartment 10, the developer is lifted by the pressure exerted by the agitation screw 11 against the gravity, thus applying stress to the developer. By contrast, the stress on the developer can be reduced by disposing the upper wall of the agitation compartment 10 higher than the surface of the bottom wall of the supply compartment 9 because the developer at a highest position in the agitation compartment 10 can flow down to a lowest position in the supply compartment 9 without defying the gravity.

It is to be noted that a fin member may be provided on a shaft of the agitation screw 11 in the third communication portion where the agitation compartment 10 communicates with the supply compartment 9, positioned on the downstream side in the developer conveyance direction in the agitation compartment 10. The fin member may be a planar member defined by sides in parallel to the axial direction of the agitation screw 11 and sides perpendicular to the axial direction of the agitation screw 11. By agitating up the developer with the fin member, the developer can be transported more efficiently from the agitation compartment 10 to the supply compartment 9.

In addition, referring to FIG. 2, the relative positions of the supply compartment 9 and agitation compartment 10 are set so that a distance A between the axial centers of the development roller 3 and the supply compartment 9 (supply screw 8) is shorter than a distance B between the axial centers of the development roller 3 and the agitation compartment 10. This arrangement can ensure reliable supply of developer from the supply compartment 9 to the development roller 3 as well as compactness of the development device 2. Additionally, the agitation screw 11 brings up the developer in the agitation compartment 10 toward the supply compartment 9 along the shape of the agitation screw 11. As a result, the developer can be brought up efficiently, thus reducing stress on the developer.

Next, as a specific feature of the first embodiment, first and second seal members for preventing developer from scattering are described below.

FIG. 3 is an enlarged view illustrating a part of the development device 2.

As shown in FIG. 3, a first end portion of the first entrance seal 4 and a first end portion of the second entrance seal 5 are fixed to the opening rim 131 upstream from the development range in the direction of rotation of the development roller 3 indicated by arrow Y2. The first end portions of the first and second entrance seals 4 and 5 mean the end portions on the upstream side in the direction of rotation of the development roller 3. The first end portion of the first entrance seal 4 is fixed to an end portion of the opening rim 131 upstream from the development range in the direction of rotation of the development roller 3 indicated by arrow Y2.

A second end portion 4A of the first entrance seal 4 and a second end portion 5A of the second entrance seal 5 are not fixed (i.e., free ends) and face the development range. The first and second entrance seals 4 and 5 are elastic sheets constructed of, for example, resin such as polyurethane (PUR) resin and polyethylene terephthalate (PET) resin.

The second end portion 4A of the first entrance seal 4 is not fixed (free end) and disposed to contact the surface of the photoreceptor 1 in the trailing direction. Thus, the clearance between the surface of the photoreceptor 1 and the opening rim 131 of the development casing 13 is filled in, preventing scattering of developer therefrom.

Additionally, the first end portion of the second entrance seal 5 is fixed to an inner wall of the opening rim 131 of the development casing 13 at a position farther from the photoreceptor 1 than the first entrance seal 4 and closer to the doctor blade 12. The second end portion 5A (free end) of the second entrance seal 5 hangs and drapes into an arc under its own weight to contact developer T that has passed through the clearance (regulation gap) under the doctor blade 12 before the developer reaches the development range.

A clearance between the surface of the development roller 3 and the second entrance seal 5 is designed so that a face 5B of the second entrance seal 5 facing the development roller 3 contacts a tip of the magnetic brush formed on the development roller 3. With this arrangement, the face 5B of the second entrance seal 5, facing the development roller 3, slidingly contacts the tip of the magnetic brush of developer T carried by the development roller 3. This configuration can inhibit the developer from accumulating on the second entrance seal 5 and falling therefrom.

Additionally, the second entrance seal 5 that contacts the developer T on the development roller 3 is not taut but drapes under its own weight. Accordingly, the stress to the developer T caused by the contact between the second entrance seal 5 and the developer T is reduced or eliminated regardless of whether the developer T forms a magnetic brush or lies on the development roller 3. Compared with a configuration in which the entrance seal is fixed in position, unevenness in the developer conveyed can be reduced.

It is to be noted that, from the following aspects, the second end portion 5A of the second entrance seal 5 is preferably positioned in an area where developer does not form a magnetic brush but lies, between the magnetic brush caused by the main development pole P1 and that caused by the conveyance pole P2 adjacent to the main development pole P1. If the second end portion 5A of the second entrance seal 5 contacts the magnetic brush formed by the main development pole P1, the magnetic brush is disturbed, thereby degrading image homogeneity.

Additionally, an aluminum deposition layer may be provided on the face 5B of the second entrance seal 5 facing the development roller 3 so that the second entrance seal 5 has a double-layer structure. This configuration can better prevent the toner from adhering to the second entrance seal 5.

As described above, according to the first embodiment, the first entrance seal 4 can inhibit scattering of developer (toner). Simultaneously, the second entrance seal 5 can inhibit developer from accumulating on the first entrance seal 4 and falling therefrom to the development range. Additionally, the stress on the developer resulting from the contact with the second entrance seal 5 whose second end portion 5A drapes under its own weight can be smaller compared with the stress resulting from the contact with a seal member both ends of which are fixed.

Additionally, in the development device 2 according to the first embodiment, the second entrance seal 5 is kept slack into an arc with a predetermined clearance provided between the development roller 3 and the face 5B of the second entrance seal 5. Thus, the second entrance seal 5 can softly contact the tip of the magnetic brush formed on the development roller 3 with the stress on the developer reduced. As a result, adhesion of developer to the face 5B of the second entrance seal 5 can be inhibited, thus preventing accumulation of developer thereon.

Additionally, the magnetic brush in the development range is not disturbed because the second end portion 5A of the second entrance seal 5 is positioned in the area where the developer does not stand on end but lies on the development roller 3.

Thus, in the development device 2 according to the present embodiment, toner can be prevented from falling and scattering. Additionally, assembling of the development device 2 can be simpler.

In the image forming apparatus including the above-described development device 2, toner can be inhibited from scattering from the development range or falling to the development range while reducing stress on the toner. Thus, high-quality images can be produced.

Next, a development device 60 according to a second embodiment is described below.

Figure 4:
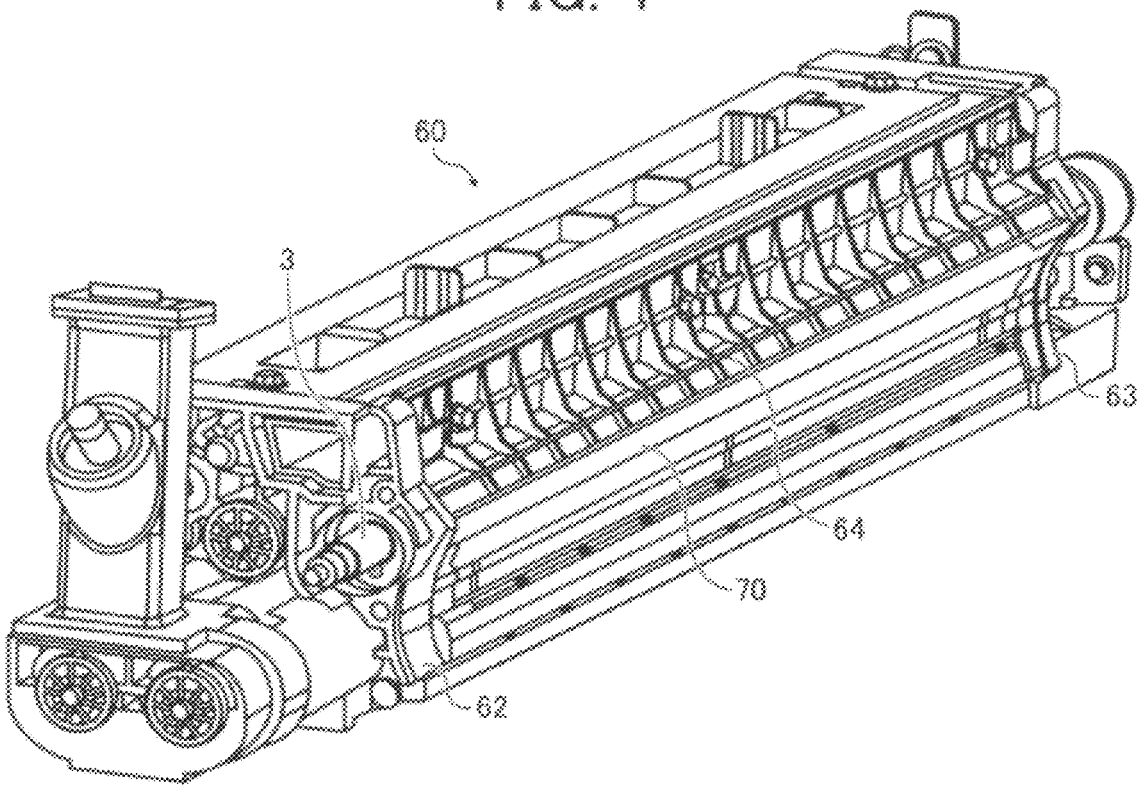
FIG. 4 is a schematic perspective diagram illustrating a configuration of a development device according to another embodiment.

FIG. 4 is a schematic perspective view illustrating the development device 60 according to the second embodiment.

The development device 60 includes a development roller 3 exposed from a development casing on a side of the photoreceptor 1. Side seals 62 and 63, a seal supporter 64, and a seal member 70 cover the exposed portion of the development roller 3 though the lower portion of the development roller 3 exposed from the development casing is not covered. Specifically, the side seals 62 and 63 are respectively provided on a front side and a back side of the development device 60 in FIG. 4. The seal member 70 is positioned beneath the seal supporter 64. The seal member 70 and the seal supporter 64 cover an upper side of the exposed portion of the development roller 3. The development roller 3 is exposed in a portion beneath the seal member 70, thus facing the photoreceptor 1.

Figure 5:
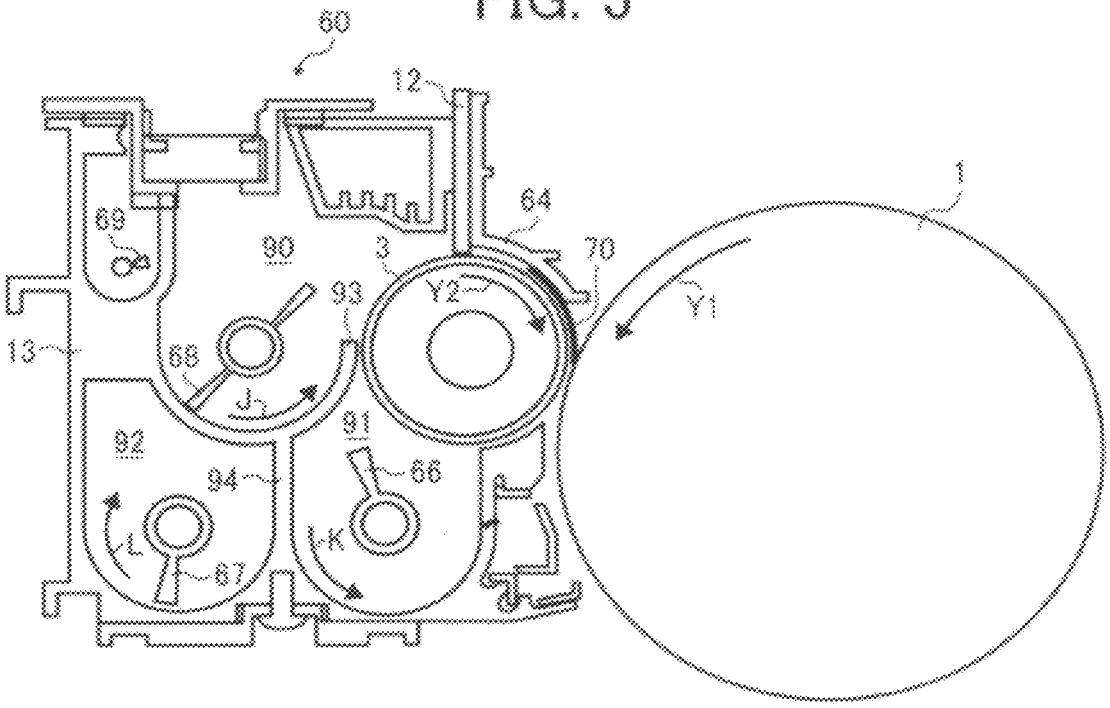
FIG. 5 is a schematic cross-sectional view illustrating a configuration of the development device shown in FIG. 4.

FIG. 5 is a schematic cross-sectional view illustrating a configuration of the development device 60.

Similarly to the four development devices 2, shown in FIG. 1, according to the first embodiment, four development devices 60 corresponding to yellow, magenta, cyan, and black, respectively, are arranged facing the respective photoreceptors 1. The four development devices 60 have a similar configuration. Two-component developer including toner and magnetic carrier is contained in the development casing (developer container) of the development device 60.

As shown in FIG. 5, the development device 60 includes a doctor blade 12, a supply screw 68, a collecting screw 66, and an agitation screw 67 similarly to the development device 2 shown in FIG. 2. An interior of the development casing is divided into a supply compartment 90, a collection compartment 91, and an agitation compartment 92.

Referring to FIG. 5, flow of developer inside the development device 60 and function of the doctor blade 12 are described below.

The development roller 3 serving as a developer bearer rotates in the direction indicated by arrow Y2 shown in FIG. 5, driven by a driving unit, and supplies toner to a latent image formed on the photoreceptor 1 facing the development roller. Thus, the latent image is developed into a toner image. The supply screw 68, serving as a developer conveyance member, includes a rotary shaft and a blade provided on the shaft, and rotates in the direction indicated by arrow J shown in FIG. 5, driven by a driving unit. The supply screw 68 supplies the developer to the development roller 3 while transporting the developer in the axial direction, that is, to the front side of the paper on which FIG. 5 is drawn. The supply compartment 90 in which the supply screw 68 is provided is positioned on a side of the development roller 3.

The collecting screw 66 is positioned downstream from the development nip (development range), where the development roller 3 faces the photoreceptor 1, in the direction indicated by arrow Y2 in which the development roller 3 rotates. The collecting screw 66 serves as another developer conveyance member and rotates in the direction indicated by arrow K, driven by a driving unit. The developer that has passed through the development nip falls to the collecting screw 66, and the collecting screw 66 conveys the developer thus received from the back side to the front side of the paper on which FIG. 5 is drawn, which is identical to the developer conveyance direction of the supply screw 68. The collecting compartment 91 in which the collecting screw 66 is provided is positioned beneath the development roller 3.

The agitation screw 67 is provided on the left of the collecting screw 66 and beneath the supply screw 66. The agitation screw 66 serves as another developer conveyance member and rotates in the direction indicated by arrow L, driven by a driving unit. The agitation screw 67 conveys the developer received from the collecting screw 66 from the front side to the back side of the paper on which FIG. 5 is drawn, which is opposite the developer conveyance direction of the collecting screw 69, while agitating the developer. The agitation compartment 92 in which the agitation screw 67 is provided is positioned on the left of collecting compartment 91 and beneath the supply compartment 90 in FIG. 5. The developer transported to the downstream end portion of the agitation compartment 92 (on the back side of the paper on which FIG. 5 is drawn) is then transported upward to the supply compartment 90. The developer that is not supplied to the development roller 3 is usually transported to the downstream end portion of the supply screw 68 and returned to the agitation screw 67. However, when the amount of developer exceeds the capacity of the development device 60, excessive developer is transported to a discharge screw 69 disposed on a side of the supply screw 68 and discharged outside the development device 60.

Although separated by a first partition 93, the supply compartment 90 and the agitation compartment 92 communicate with each other in both end through openings, namely, a first communication portion and a third communication portion, respectively formed on the front side and the back side of paper on which FIG. 5 is drawn so that the developer can move therethrough. It is to be noted that the supply compartment 90 and the collecting compartment 91 are separated by the first partition 93 as well, and no opening is formed in that portion of the first partition 93. Thus, the supply compartment 90 does not communicate with the collecting compartment 91.

Additionally, a second separation wall 94 that includes a portion separating the agitation compartment 92 from the collecting compartment 91 is provided. Although separated by the second separation wall 94, an opening (second communication portion) through which the agitation compartment 92 communicates with the collecting compartment 91 is formed in the second separation wall 94 in an end portion on the front side of the paper on which FIG. 5 is drawn.

After being used in image development, the developer is collected in the collecting compartment 91 and then is conveyed to the front side of the paper on which FIG. 5 is drawn. The collected developer is further conveyed through the opening (second communication portion) formed in the second separation wall 94, in a non-image area, to the agitation compartment 92. It is to be noted that toner is supplied to the agitation compartment 92 through a toner supply port (not shown) formed on an upper side of the agitation compartment 92, positioned close to the opening formed in the second separation wall 94.

Additionally, the developer supplied to the developing roller 3 is adjusted to have a desired or given thickness by the doctor blade 12, serving as the developer regulator, disposed downstream from the portion where the development roller 3 faces the supply screw 68 in the direction indicated by arrow Y2 in which the development roller 3 rotates. The layer thickness of the developer on the development roller 3 downstream from the doctor blade 12 is thus adjusted.

The doctor blade 12 may be constructed of, for example, a long, substantially rectangular nonmagnetic planar member and a long, substantially rectangular magnetic planar member. The magnetic planar member is smaller in size than the nonmagnetic planer member. Examples of a material of the nonmagnetic planer member include stainless steel of grade SUS (Special Use Stainless) 304 and SUS 316. Examples of a material of the magnetic planer member include SUS 430. The magnetic planar member is thinner than the nonmagnetic planar member. For example, the thickness of the nonmagnetic planer member is about 1 mm to 3 mm, and that of the magnetic planar member is about 0.1 mm to 0.3 mm.

After adjusted into a thin layer by the doctor blade 12, the developer on the development roller 3 is conveyed to the development range facing the photoreceptor 1 and used in image development.

In the present embodiment, the supply screw 68, the collecting screw 66, and the agitation screw 67, serving as the developer conveyance members, can be screws made of resin or metal and have a diameter of about 22 mm, for example. The supply screw 68 may be double threaded and have a screw pitch of about 50 mm. The collecting screw 66 and the agitation screw 67 may be single threaded and have a screw patch of about 25 mm. The rotational frequency of these screws can be set at 700 rpm, for example.

Additionally, the seal supporter 64, forming a part of the development casing, extends to a position adjacent to the development nip between the development roller 3 and the photoreceptor 1. A predetermined clearance is provided between the seal supporter 64 and the outer circumference of the cylindrical development roller 3.

To prevent scattering of toner before and after image development, the seal member 70 is provided to the development casing. The seal member 70 is attached to the seal supporter 64, that is, supported by, for example, an inner face of the seal supporter 64, and extends to a position adjacent to the development nip between the development roller 3 and the photoreceptor 1 with a predetermined clearance provided between the seal member 70 and the outer circumference of the development roller 3.

Prevention of scattering of toner using a seal member in a comparative example is described below with reference to FIGS. 7 and 8.

Figure 7:
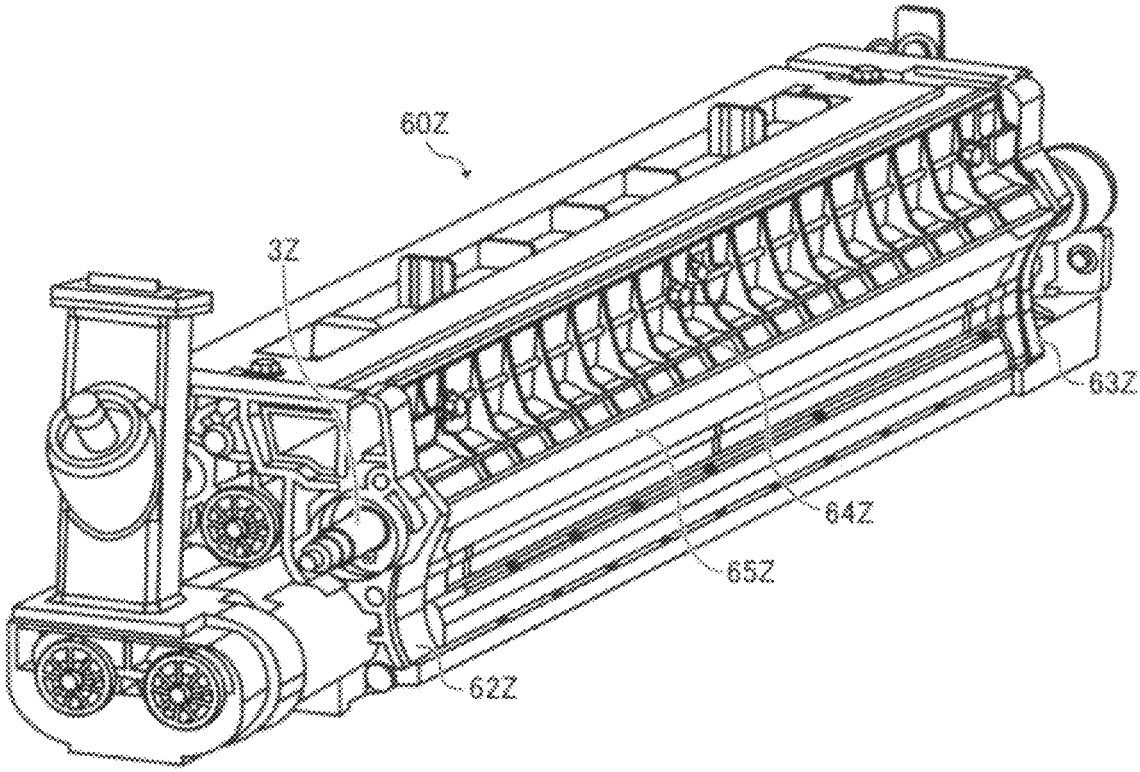
FIG. 7 is a schematic perspective view illustrating a development device according to a comparative example.
Figure 8:
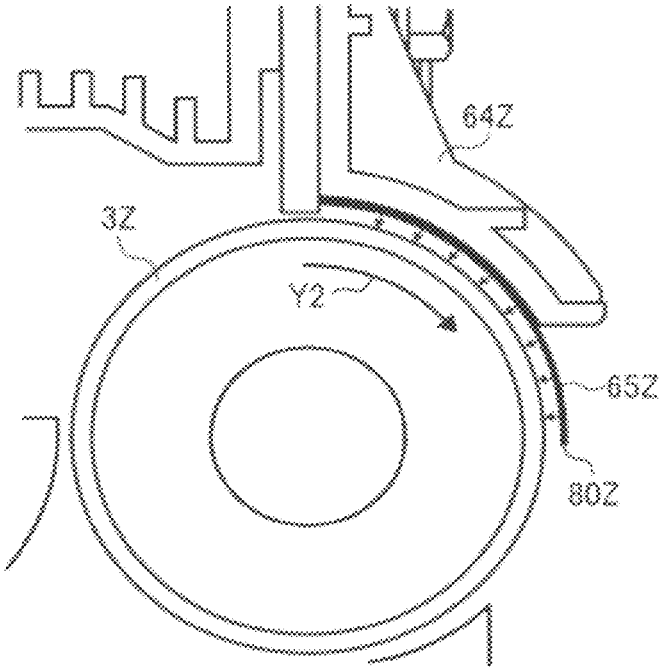
FIG. 8 is an enlarged cross-sectional view illustrating a configuration adjacent to a development roller and a seal supporter in the comparative example.

In a comparative development device 60Z shown in FIGS. 7 and 8, a surface 80Z of a seal member 65Z facing a development roller 3Z is constructed of an electroconductive member that is grounded to prevent accumulation of electrical charges on the seal member 65Z resulting from friction. This configuration is aimed at preventing toner from adhering to the seal member 65Z.

However, when such a grounded surface is present adjacent to the development roller 3Z, an electrical field is generated by differences in electrical potential between the grounded surface and the development roller 3Z. As a result, toner can adhere to the grounded surface with the effects of the electrical field even if there is no accumulation of electrical charges on the grounded surface. Then, the negative toner adheres to the grounded surface 80Z, receiving a force toward the grounded surface 80Z from the electrical field. Therefore, in the comparative example, it is possible that the toner falls suddenly from the grounded surface 80Z under its own weight or upon an impact, degrading image quality or contaminating the interior of the apparatus.

As described above, an insulative seal member provided around the development roller 3Z can be charged electrically by the friction with toner or the like. Consequently, toner can adhere to the seal member 65Z.

In view of the foregoing, the development device 60 according to the second embodiment is designed to inhibit adhesion of toner to the seal member 70 resulting from the electrical field generated between the development roller 3 and the seal member 70, thereby preventing degradation of image quality and contamination inside the apparatus.

Figure 6:
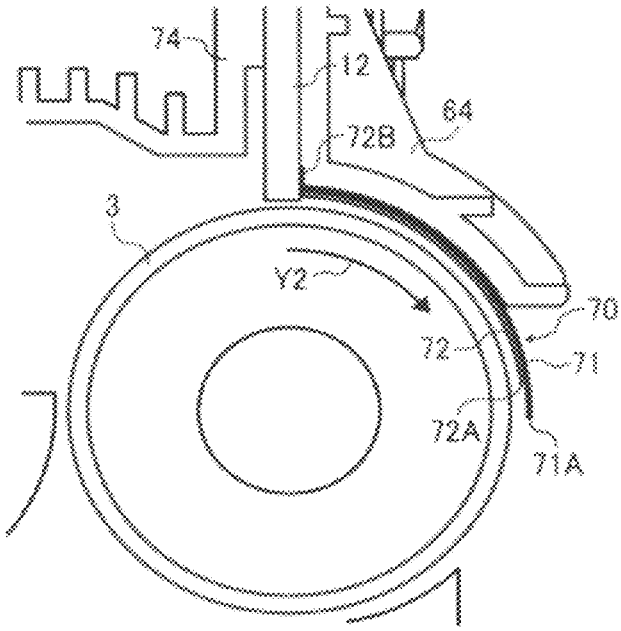
FIG. 6 is an enlarged cross-sectional view illustrating a configuration adjacent to a development roller and a seal supporter.

FIG. 6 is an enlarged cross-sectional view illustrating the development roller 3 and the seal supporter 64.

The seal member 70 in the present embodiment has a double-layered structure and includes an insulative sheet 71 (insulator) and an electroconductive sheet 72 (conductive member). The conductive sheet 72 is on the side of the development roller 3, and the insulative sheet 71 is on the side of the photoreceptor 1.

The electroconductive surface, that is, the surface having electrical charges, of the seal member 70 facing the development roller 3 can inhibit adhesion of toner to the seal member 70. The nonconductive surface of the seal member 70 facing the photoreceptor 1 can reduce adverse effects to the latent image on the surface of the photoreceptor 1. For example, urethane is preferable for the insulative sheet 71. The electroconductive sheet 72 can be a polyethylene terephthalate (PET) sheet on which aluminum is deposited and disposed with the conductive side facing the development roller 3. Alternatively, a conductive urethane sheet may be used.

PET sheets including an aluminum deposition layer can follow a curved surface easily. Therefore, with use of such a PET sheet with an aluminum deposition layer, electrical potentials can be given to the surface of the seal member 70 facing the development roller 3 easily at a lower cost. Toner is less likely to adhere to urethane sheets, and urethane is not easily degraded. Thus, urethane sheets can reliably prevent adhesion of toner to the seal member 70.

The insulative sheet 71 may be bonded to the inner side of the seal supporter 64 facing the development roller 3 either entirely or partially using double-sided adhesive tape or the like. The electroconductive sheet 72 may be bonded to either a side of the insulative sheet 71 or a part of the inner side of the seal supporter 64 facing the development roller 3 using double-sided adhesive tape or the like. Thus, the insulative sheet 71 is on the side of the seal supporter 64, while the conductive sheet 72 is on the side of the development roller 3. It is to be noted that an end portion 72B of the electroconductive sheet 72 may be clamped between the doctor blade 12 and the seal supporter 64.

An end portion 71A of the insulative sheet 71 is in contact with the photoreceptor 1. By contrast, the electroconductive sheet 72 is shorter than the insulative sheet 71 in the circumferential direction of the development roller 3, and an end portion 72A thereof does not contact the photoreceptor 1. Toner can be effectively prevented from scattering or falling from the development roller 3 by disposing the insulative sheet 71 with its edge face 71A in contact with the photoreceptor 1. Additionally, it is preferable that the electroconductive sheet 72, curved into a partial cylinder, is shorter than the seal supporter 64 and longer than the seal supporter 64 in the circumferential direction of the development roller 3.

Another end portion 72B of the electroconductive sheet 72 is in contact with the doctor blade 12. The doctor blade 12 is connected to the development roller 3 via a heatsink 74 and another conductor such as a metal sheet, and the electrical potential of the doctor blade 12 is identical or similar to that of the development roller 3. Accordingly, the electrical potential of the electroconductive sheet 72 is identical or similar to that of the development roller 3. This configuration can eliminate differences in electrical potential between the development roller 3 and the electroconductive sheet 72, thereby preventing generation of electrical fields. Consequently, there can be no force directing the toner toward the electroconductive sheet 72. It is to be noted that the development roller 3 is connected to a bias circuit provided inside the apparatus body of the image forming apparatus 500 and given electrical potentials, receiving power.

In this case, in the area where the electroconductive sheet 72 is present, the space between the electroconductive sheet 72 and the development roller 3 can be kept at an identical or similar electrical potential, preventing generation of electrical fields. Accordingly, extending the electroconductive sheet 72 is advantageous for preventing the toner from scattering.

Alternatively, the electrical potentials of the electroconductive sheet 72 and the development roller 3 may be adjusted to generate an electrical field between the electroconductive sheet 72 and the development roller 3 for attracting the scattering toner toward the development roller 3. For example, in the case of negative toner, when the electrical potentials of the development roller 3 and the electroconductive sheet 72 are respectively −600 V and −800 V, the difference can generate an electrical field in the direction from the development roller 3 to the electroconductive sheet 72. Then, the negative toner receives a force in the direction from the electroconductive sheet 72 to the development roller 3. Thus, adhesion of toner to the electroconductive sheet 72, the supporter 64 can be inhibited. Consequently, toner adhering to such elements does not fall therefrom suddenly under its own weight or upon an impact, and image failure and contamination of the interior of the apparatus can be reduced.

Figure 9:
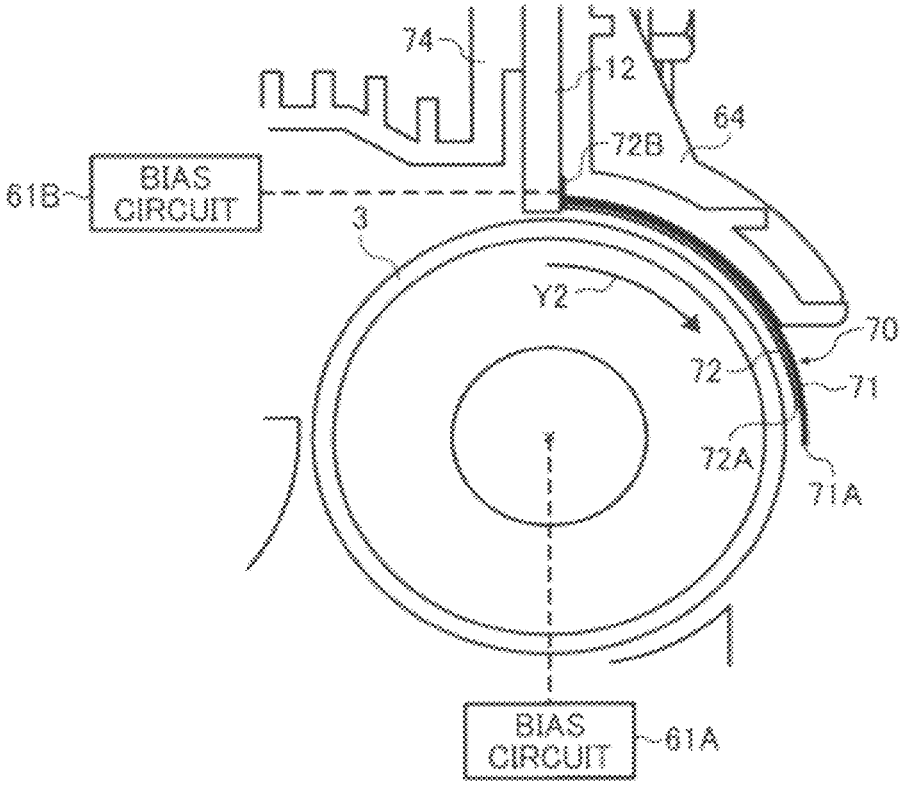
FIG. 9 is an enlarged cross-sectional view illustrating a variation in which a development roller and an electroconductive sheet of a seal member are connected to separate bias circuits.

In this case, the electroconductive sheet 72 and the development roller 3 are not connected together via a conductor. Instead, as shown in FIG. 9, the development roller 3 and the electroconductive sheet 72 and connected to separate bias circuits, namely, bias circuits 61A and 61B, provided inside the apparatus body so that desired electrical potentials can be given to them separately.

In the present embodiment, the seal member 70 and the development roller 3 (developer bearer) can have an identical or similar electrical potential, and electrical fields that attract scattering toner to the seal member 70 are not generated between the seal member 70 and the development roller 3. This configuration can inhibit image failure and contamination inside the apparatus resulting from adhesion of toner to the seal member 70 and falling of toner therefrom. Alternatively, scattering toner can be attracted to the development roller 3 by the electrical field generated between the seal member 70 and the development roller 3.

Additionally, the photoreceptor 1 and at least one of components provided around the photoreceptor 1, namely, the charging unit, the development device 2 or 60, and the drum cleaning unit, may be housing in a common unit casing, forming a process cartridge (modular unit) removably installable in the apparatus body of the image forming apparatus 500. This configuration can facilitate replacement and maintenance work and keep the relative positions of the components at a higher degree of accuracy, thus enhancing image quality. Further, with the process cartridge, scattering of toner and image failure can be reduced.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a development casing including a rim which is curved;

a developer bearer to carry by rotation two-component developer including toner and carrier, the developer bearer disposed facing a latent image bearer through an opening formed in the development casing, the rim of the development casing being curved around the developer bearer;

a magnetic field generator disposed inside the developer bearer;

a developer regulator to adjust an amount of developer carried on the developer bearer, the developer regulator disposed upstream from a development range in a direction of rotation of the developer bearer and facing the developer bearer across a predetermined gap;

a first seal member to cover a clearance between the latent image bearer and the rim of the development casing adjacent to and upstream from the opening, the first seal member including a first end portion fixed to the rim of the development casing upstream from the development range in the direction of rotation of the developer bearer, and a second end portion in contact with the latent image bearer; and a second seal member including a first end portion fixed to an inner face of the development casing farther from the latent image bearer than the first end portion of the first seal member, and a second end portion hanging under its own weight to contact the developer carried on the developer bearer downstream from the developer regulator in the direction of rotation of the developer bearer, wherein the first end portion of the first seal member is fixed to an inner portion of the rim of the development casing.

2. The development device according to claim 1, wherein the second seal member is curved into a partial cylinder in a circumferential direction of the developer bearer with a predetermined clearance provided between an outer circumferential surface of the developer bearer and an inner face of the second seal member facing the developer bearer, and the inner face of the second seal member contacts a tip of a magnetic brush formed by the developer on the developer bearer due to a magnetic field generated by the magnetic field generator.

3. The development device according to claim 2, wherein the magnetic field generator includes a main development pole facing the development range and a developer conveyance pole adjacent to and upstream from the main development pole in the direction of rotation of the developer bearer, and the second end portion of the second seal member is positioned in an area between the main development pole and the developer conveyance pole where the developer lies down on the developer bearer.

4. An image forming apparatus comprising:

a latent image bearer on which a latent image is formed; and the development device according to claim 1.

5. The development device according to claim 1, wherein:

the first and second seal members are fixed to a portion of an inner circumferential face of the development casing facing the developer bearer.

6. The development device according to claim 1, wherein:

the developer casing includes a thinned inner portion having a thickness which is thinner than a portion of the developer casing that is not thinned, and the first end of the first seal member is fixed to the thinned inner portion.

7. The development device according to claim 6, wherein:

a radius extending from a center of the developer bearer passes through the second seal member, the first seal member, and the thinned inner portion to which the first seal member is fixed.

8. A development device comprising:

a development casing including a rim which is curved;

a developer bearer to carry by rotation two-component developer including toner and carrier, the developer bearer disposed facing a latent image bearer through an opening formed in the development casing, the rim of the development casing being curved around the developer bearer;

a magnetic field generator disposed inside the developer bearer;

a developer regulator to adjust an amount of developer carried on the developer bearer, the developer regulator disposed upstream from a development range in a direction of rotation of the developer bearer and facing the developer bearer across a predetermined gap;

a first seal member to cover a clearance between the latent image bearer and the rim of the development casing adjacent to and upstream from the opening, the first seal member including a first end portion fixed to the rim of the development casing upstream from the development range in the direction of rotation of the developer bearer, and a second end portion in contact with the latent image bearer; and a second seal member including a first end portion fixed to an inner face of the development casing farther from the latent image bearer than the first end portion of the first seal member, and a second end portion hanging under its own weight to contact the developer carried on the developer bearer downstream from the developer regulator in the direction of rotation of the developer bearer, wherein:

the developer casing includes a thinned inner portion having a thickness which is thinner than a portion of the developer casing that is not thinned, and the first end of the first seal member is fixed to the thinned inner portion.

9. The development device according to claim 8, wherein:

a radius extending from a center of the developer bearer passes through the second seal member, the first seal member, and the thinned inner portion to which the first seal member is fixed.

10. The development device according to claim 8, wherein the second seal member is curved into a partial cylinder in a circumferential direction of the developer bearer with a predetermined clearance provided between an outer circumferential surface of the developer bearer and an inner face of the second seal member facing the developer bearer, and the inner face of the second seal member contacts a tip of a magnetic brush formed by the developer on the developer bearer due to a magnetic field generated by the magnetic field generator.

11. The development device according to claim 10, wherein the magnetic field generator includes a main development pole facing the development range and a developer conveyance pole adjacent to and upstream from the main development pole in the direction of rotation of the developer bearer, and the second end portion of the second seal member is positioned in an area between the main development pole and the developer conveyance pole where the developer lies down on the developer bearer.

12. An image forming apparatus comprising:

a latent image bearer on which a latent image is formed; and the development device according to claim 8.

13. The development device according to claim 8, wherein:

the first end portion of the first seal member is fixed to an inner portion of the rim of the development casing.

14. The development device according to claim 8, wherein:

the first and second seal members are fixed to a portion of an inner circumferential face of the development casing facing the developer bearer.

* * * * *